US006333376B1

(12) United States Patent
Geissbuhler

(10) Patent No.: US 6,333,376 B1
(45) Date of Patent: Dec. 25, 2001

(54) PLASTIC SKI COATING

(75) Inventor: Urs Geissbuhler, Thun (CH)

(73) Assignee: IMS Kunststoff AG, Ittigen-Bern (CH)

( * ) Notice: Subject to any disclaimer, the term of this patent is extended or adjusted under 35 U.S.C. 154(b) by 0 days.

(21) Appl. No.: 09/571,323

(22) Filed: May 15, 2000

(30) Foreign Application Priority Data

May 17, 1999 (EP) ..... 99109681

(51) Int. Cl.[7] ..... C08J 7/04; A63C 5/12

(52) U.S. Cl. ..... 524/404; 524/428; 524/437; 508/155; 508/172

(58) Field of Search ..... 524/404, 428, 524/437; 508/155, 172

(56) References Cited

U.S. PATENT DOCUMENTS 5,409,622 * 4/1995 Chapman et al. ..... 252/12

FOREIGN PATENT DOCUMENTS

66193A * 2/1986 (CH) .
657993 10/1986 (CH) .
660018 3/1987 (CH) .

* cited by examiner

*Primary Examiner*—Margaret Medley
(74) *Attorney, Agent, or Firm*—Shoemaker and Mattare

(57) ABSTRACT

The plastic ski coating contains a filling material addition improving the sliding properties, which contains at least one of the following materials: boron, at least one boron compound, at least one nitride. With this the filling material addition quantity may be smaller than with a filling material addition of soot or graphite, and a black coloration of the ski coating may be avoided.

15 Claims, No Drawings

PLASTIC SKI COATING

The invention relates to a plastic ski coating with a particlelike filling material addition improving the sliding characteristics.

For plastic ski coatings preferably materials with a hydrophobic character are applied, such as for example polyethylene.

The sliding mechanism on snow or ice with skis to which here are also counted "snowboards" is a complex procedure and is not known in every detail. One always assumes that roughness peaks of the running surface come into contact with the snow crystals and the frictional heat produced with this leads to their melting. The water which with this is produced locally between the running surface and the snow leads to hydrodynamic lubrication conditions, by which means the low kinetic friction coefficients of about 0.02 to 0.05 may be explained. The kinetic friction coefficients with solid body friction without hydrodynamic lubrication measured on skiing lie about 10 times higher.

Furthermore it has been shown that with higher speeds the locally formed melting water has the tendency to widen out over the whole running surface which leads to an undesired "suction effect" negatively influencing the sliding speed. By way of admixing materials such as for example carbon in the modifications of soot and/or graphite, which with respect to the non modified polyethylene matrix have a high heat conductability, this negative "suction effect" may be prevented or reduced (cf. e.g. CH-A-657993 or CH-A-660018).

The superiority of running surface materials of C-modified PE with respect to the sliding speed has in the last years led to the fact that they make up the greatest part of the ski coating used in ski manufacture. These ski coatings contain the filling material carbon in a relatively large quantity. Caused by the intrinsic colour of carbon in the modifications soot and graphite, these fast-sliding ski coatings have a black colour.

The object of the invention lies in providing a filling material addition which for the desired sliding properties may be added to the ski coating in a significantly lower quantity than the usual carbon and with which the black colouration may be avoided so that the ski coating may be formed with regard to colour by the addition of suitable colourants.

The plastic ski coating according to the invention with which the object is achieved is characterised in that the filling material addition contains at least one of the following substances: boron, at least one boron compound, at least one nitride.

As a nitride the filling material addition may usefully contain boron nitride.

In the preferred embodiment form the filling material addition thus contains at least one of the following substances: boron, boron nitride, aluminium nitride.

The filling material addition may additionally also yet contain carbon in the form of soot and/or graphite.

The quantity of the filling material addition is as a rule 0.2 to 20, preferably 0.5 to 3 parts by weight to 100 parts by weight of plastic. The used plastic may usefully be ultra-high molecular low-pressure polyethylene with a molar mass of 4 to $12\times10^6$ g/mol, which is processed in a press-sintering method, or low-pressure polyethylene with a molar mass of 200,000 to 600,000 g/mol, which is processed in the extrusion method.

EXAMPLE 1

95 parts by weight of ultra-high molecular low-pressure polyethylene "Hostalen GUR" 4120 with a molar mass of $5\times10^6$ are intimately mixed with 5 parts by weight of boron with a grain size of approx. 10 $\mu$m in a mixer 15 minutes long and thereafter is press-sintered on a cylinrical press mould under know heat and pressure conditions (such as e.g. specified in the brochure of Hoechst of their low-pressure polyethylene "Hostalen GUR" [brochure HRK112–7089C12299/14]) to a homogeneous cylindrical sinter body. After cooling down, from the cylindrical sinter body there is peeled off a continuous tape in the desired thickness of the ski coating of e.g. 1.3 mm. Thereafter in the known way and manner it is roughened on one side with an abrasive tape and by way of an oxidising gas/air flame is prepared for the adhesing to the ski body.

Of course the ski coating may not only be manufactured in the press sintering method with a subsequent peeling, but also for example in the extrusion method. Essential to the invention is the admixture of the initially mentioned filling material addition.

EXAMPLE 2

99 parts of "Hostalen GUR" 4120 were processed with 1 part by weight of boron nitride powder (specific surface 6.3 $m^2/g$) as described in Example 1 into a ski coating. The coating is homogeneously white.

EXAMPLE 3

96 parts by weight of "Hostalen GUR" 4170 with a molar mass of $10.5\times10^6$ were processed with 4 parts by weight of aluminium nitride powder (specific surface 1.2 $m^2/g$) as in Example 1 into a ski coating. The coating has a greyish, homogeneous colour.

Comparative Example A (not according to the invention)

Analogous to Example 1, 100 parts by weight of "Hostalen GUR" 4120 without filling material was processed to a ski coating. The coating is milky white and translucent.

Comparative Example B (not according to the invention).

Analogously to Example 1, 85 parts by weight of "Hostalen GUR" 4120 was mixed with 15 parts by weight of soot (particle size 20 nm) and processed to a ski coating.

Measuring results

A test stretch was passed through with skis identical in design, differing by the used coating, with an average speed of 100 km/h and the time required for this was acquired by way of electronic time measurement. On old snow with a temperature of −1.3° C. at air temperatures of −1 to +2° C. and air humidities of 58 to 64% the following times were measured:

| Running surface according to example | composition of the running surface (parts by weight) | measured time |
|---|---|---|
| 1 | PE [95]<br>B [5] | 17,014 sec |
| 2 | PE [99]<br>BN [1] | 16,981 sec |
| 3 | PE [96]<br>AlN [4] | 16,968 sec |

-continued

| Running surface according to example | composition of the running surface (parts by weight) | measured time |
|---|---|---|
| A | PE [100] | 17,795 sec |
| B | PE [85]<br>C [15] | 16,963 sec |

It is therefore seen that with the ski coatings according to the invention according to Example 1, 2 or 3 with respect to a ski coating without the filling material addition (comparative Example A) a similar improvement of the sliding properties is achieved as with a ski coating with soot addition (according to comparative Example B), wherein however the filling material addition quantities in the ski coatings according to the invention are significantly smaller and wherein the black colouration is avoided.

What is claimed is:

1. A plastic ski coating having improved sliding properties, said coating comprising:

a low pressure polyethylene powder or granulate material and, intimately mixed therewith, an additive selected from the group consisting of boron, boron nitride, and, nitride, aluminum and mixtures thereof, wherein the additive constitutes about 0.2% to 20% by weight of the coating.

2. A plastic ski coating according to claim 1, wherein the additive contains aluminum nitride.

3. A plastic ski coating according to claim 1, wherein the additive contains boron nitride.

4. A plastic ski coating according to claim 1, wherein the additive contains elemental boron.

5. A plastic ski coating according to claim 1, further comprising a carbon additive soot, graphite and soot and graphite.

6. A plastic ski coating according to claim 1, wherein the additive consists of about 4% by weight of aluminum nitride powder and about 96% by weight of said polyethylene.

7. A plastic ski coating according to claim 1, wherein the additive consists of about 1% by weight of boron nitride powder and about 99% by weight of said polyethylene.

8. A plastic ski coating according to claim 1, wherein the additive consists of about 5% by weight of boron grains with an approximate size of 10 $\mu$m and about 95% by weight of said polyethylene.

9. A plastic ski coating according to claim 1, wherein said polyethylene is processed by press-sintering.

10. A plastic ski coating according to claim 9, wherein said polyethylene have a molecular weight of 4,000,000 to 12,000,000 g/mol.

11. A plastic ski coating according to claim 1, wherein said polyethylene is extruded polyethylene having a molecular weight of 200,000 to 600,000 g/mol.

12. A plastic ski coating according to claim 1, containing 0.5 to 4% by weight of said additive for 100 parts of said polyethylene.

13. A plastic ski coating according to claim 12, wherein said polyethylene is processed by press-sintering.

14. A plastic ski coating according to claim 13, wherein said polyethylene have a molecular weight of 4,000,000 to 12,000,000 g/mol.

15. A plastic ski coating according to claim 12, wherein said polyethylene is extruded polyethylene with a molecular weight of 200,000 to 600,000 g/mol.

* * * * *